US006563423B2

(12) United States Patent
Smith

(10) Patent No.: US 6,563,423 B2
(45) Date of Patent: May 13, 2003

(54) LOCATION TRACKING OF INDIVIDUALS IN PHYSICAL SPACES

(75) Inventor: Gordon James Smith, Rochester, MN (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/796,860

(22) Filed: Mar. 1, 2001

(65) Prior Publication Data

US 2002/0121979 A1 Sep. 5, 2002

(51) Int. Cl.[7] ..... G08B 13/14

(52) U.S. Cl. ..... 340/572.1; 340/572.4; 340/572.6; 340/572.8

(58) Field of Search ..... 340/572.1, 572.4, 340/572.6, 572.5, 572.8, 573.1, 573.4, 10.01, 10.42, 10.51, 10.52, 825.36, 5.8, 5.81

(56) References Cited

U.S. PATENT DOCUMENTS 4,555,696 A * 11/1985 Brown ..... 340/551
4,929,928 A * 5/1990 Hultker ..... 340/572.1
5,305,390 A 4/1994 Frey et al. ..... 382/2
5,317,309 A * 5/1994 Vercellotti et al. ..... 340/10.1
5,587,703 A * 12/1996 Dumont ..... 340/572.1
5,640,002 A 6/1997 Ruppert et al. ..... 235/472
5,973,732 A * 10/1999 Guthrie ..... 348/169
5,995,015 A * 11/1999 DeTemple et al. ..... 340/825.49
6,098,048 A 8/2000 Dashefsky et al. ..... 705/10
6,104,333 A * 8/2000 Wood, Jr. ..... 341/173
6,123,259 A * 9/2000 Ogasawara ..... 235/380

* cited by examiner

*Primary Examiner*—Toan N Pham
(74) *Attorney, Agent, or Firm*—Wood, Herron & Evans, LLP

(57) ABSTRACT

A location tracking system for individuals is capable of being used in a number of environments, including in retail or other commercial environments to track the movements of customers. An electronic tagging method and apparatus apply an electronically-readable tag to an individual, where the electronically-readable tag is comprised of a magnetic composition that is applied to an individual's footwear, and magnetized with an electronically-readable code. A location tracking method and apparatus determine an electronically-readable code from a magnetic composition applied to an individual's footwear and sensed by a magnetic sensor. A method and apparatus also track customers in an establishment by tagging a plurality of customers when entering the establishment, so that each is assigned a unique electronically-readable code. The location of each electronically-tagged customer is then tracked using a plurality of proximity sensors disposed at a plurality of locations in the establishment, with each proximity sensor configured to detect the unique electronically-readable code of a customer that is located proximate thereto.

45 Claims, 3 Drawing Sheets

LOCATION TRACKING OF INDIVIDUALS IN PHYSICAL SPACES

FIELD OF THE INVENTION

The invention is generally directed to location tracking, and in particular to the tracking of individuals within physical spaces, e.g., customers within a retail establishment. The invention is also directed to manners of applying electronically-readable tags to individuals and sensing the locations of such tags.

BACKGROUND OF THE INVENTION

Consumer-oriented marketing and sales have become significantly more sophisticated since the days of mom and pop retail establishments. Significant research has been devoted to improving the efficiency of retail establishments through improved store layouts, product placements, product displays and point of sale advertisements, all of which have been found to impact sales. As an example, grocery stores have for many years put staple items such as milk and bread in the rear part of a store so that customers will need to walk through much of the store to get those items, and hopefully find other items for purchase on the way. Similarly, grocery stores often organize product displays to locate complimentary items (e.g., ice cream and ice cream cones) close to one another so that customers are encouraged to purchase those complimentary items.

Retail enterprises have also expended significant efforts in improving the overall shopping experience of their customers, as customers that enjoy shopping in a particular store are more likely to buy more products and to return for future visits. Poor experiences such as long lines at the checkout register, crowded aisles, bottlenecks, unfriendly sales staff, etc. detract from the overall shopping experience, and may hurt sales. In addition, the flow of customers through an establishment can raise some safety issues particularly if customers crowd in particular locations of a store.

An efficiently run retail enterprise tends to have more repeat customers, higher revenues and thus, greater profits. Therefore, a continuing need exists for monitoring store efficiency and performance so that problems can be identified and improvements implemented. One type of data that is believed to be helpful in analyzing store performance relates to the flow of customers throughout a store, e.g., where customers are at any given time, how long they stay in the store, how long they linger in certain areas of a store, how quickly they move between areas, etc. Such information is believed to have a number of uses, e.g., in determining marketing effectiveness, traffic flow, safety issues, etc. However, to date the logging of such information is difficult and manually intensive.

For example, it would be possible to track customer location data by positioning workers in different locations in a store, and having those workers log the number of customers coming and going in their area. Perhaps more efficiently, the video surveillance systems utilized by security personnel in many stores could be used to collect customer location data; however, a person would still be required to monitor the security cameras and manually log customer information. Moreover, the movement of individual customers would be difficult, if not impossible, to track in many instances.

Anytime an individual is involved in logging information such as location information, human error is introduced, as is relatively high labor cost. It would be extremely desirable to automate the task of logging customer location information in a retail establishment; however, existing technologies are not readily adapted to gathering customer location for the purposes discussed above.

For example, location tracking devices have been used in a number of environments outside of retail establishments to track objects, animals and people. For example, radio transmitters have been used to track wild animals, and Global Positioning System (GPS) devices have been used to track a wide variety of entities, e.g., service fleet vehicles.

The various known location tracking devices, however, have a number of limitations that limit their usefulness in tracking the customers of retail establishments. First, customers would typically need to be given dedicated electronic devices to carry as the customers browse through a store. Requiring customers to carry devices, however, is obtrusive, and could potentially offend some customers. Moreover, individual devices would be relatively expensive, introducing a risk of theft, and likely limiting the total number of customers that could be tracked at any given instance.

Therefore, a need still exists for an automated manner of tracking location of customers within a retail establishment, and in particular, for a customer tracking system that is less expensive, more reliable and less obtrusive than could be implemented using conventional tracking technology.

SUMMARY OF THE INVENTION

The invention addresses these and other problems associated with the prior art by providing a location tracking system for individuals that is capable of being used in a number of environments, including in retail or other commercial environments, to track the movements of customers in an automated fashion. The location tracking system may utilize electronically-readable tags formed of magnetic composition and applied to individuals' footwear, with the magnetic composition encoded with a unique code for each individual. Through the sensing of the tags with magnetic sensors disposed at one or more sensor locations, specific individuals may often be tracked in a reliable, unobtrusive and cost effective manner.

Therefore, consistent with one aspect of the invention, a unique electronic tagging method and apparatus are provided for applying an electronically-readable tag to an individual. The electronically-readable tag is comprised of a magnetic composition that is applied to an individual's footwear, and magnetized with an electronically-readable code.

Consistent with another aspect of the invention, a unique location tracking method and apparatus are provided for determining an electronically-readable code from a magnetic composition applied to an individual's footwear and sensed by a magnetic sensor.

Consistent with still another aspect of the invention, a method and apparatus are provided for tracking customers in an establishment. A plurality of customers are tagged when they enter the establishment, and each is assigned a unique electronically-readable code. The location of each electronically-tagged customer is then tracked using a plurality of proximity sensors disposed at a plurality of locations in the establishment, with each proximity sensor configured to detect the unique electronically-readable code of a customer that is located proximate thereto.

While each of the aforementioned aspects of the invention may have separate utility from the other aspects, when combined these aspects of the invention can provide a relatively robust, inexpensive, reliable and unobtrusive manner of logging customer location and related data in a physical retail environment. Moreover, such data can be used for a variety of useful purposes, e.g., to gauge marketing and advertising effectiveness, traffic flow, safety, architectural design, etc.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described exemplary embodiments of the invention.

DETAILED DESCRIPTION

The embodiments discussed hereinafter focus on the tracking of customers in a physical space such as a retail establishment, or even a collection of retail establishments (e.g., within a mall or multiple locations for a retail chain). However, it will be appreciated that aspects of the invention may apply to other environments where it may be desirable to track the locations of individuals, whether in other commercial settings, industrial settings, government settings, or other public or private settings, etc. Thus, while the focus hereinafter will be on retail customer tracking, it should be appreciated that the invention is not limited solely to such an application.

To implement customer tracking consistent with the invention, a customer tracking system is provided, incorporating both the ability to apply electronic tags to customers, and to sense the locations of electronically-tagged customers. In addition, the tracking data generated by a customer tracking system has a number of end uses, e.g., in terms of marketing analysis, architectural analysis, traffic analysis, safety analysis, etc. The discussion hereinafter will first address the overall customer tracking system, followed by additional detail on the tagging and sensing subsystems, and then a discussion of the operation and utilization of customer tracking data.

Customer Tracking System

Figure 1:
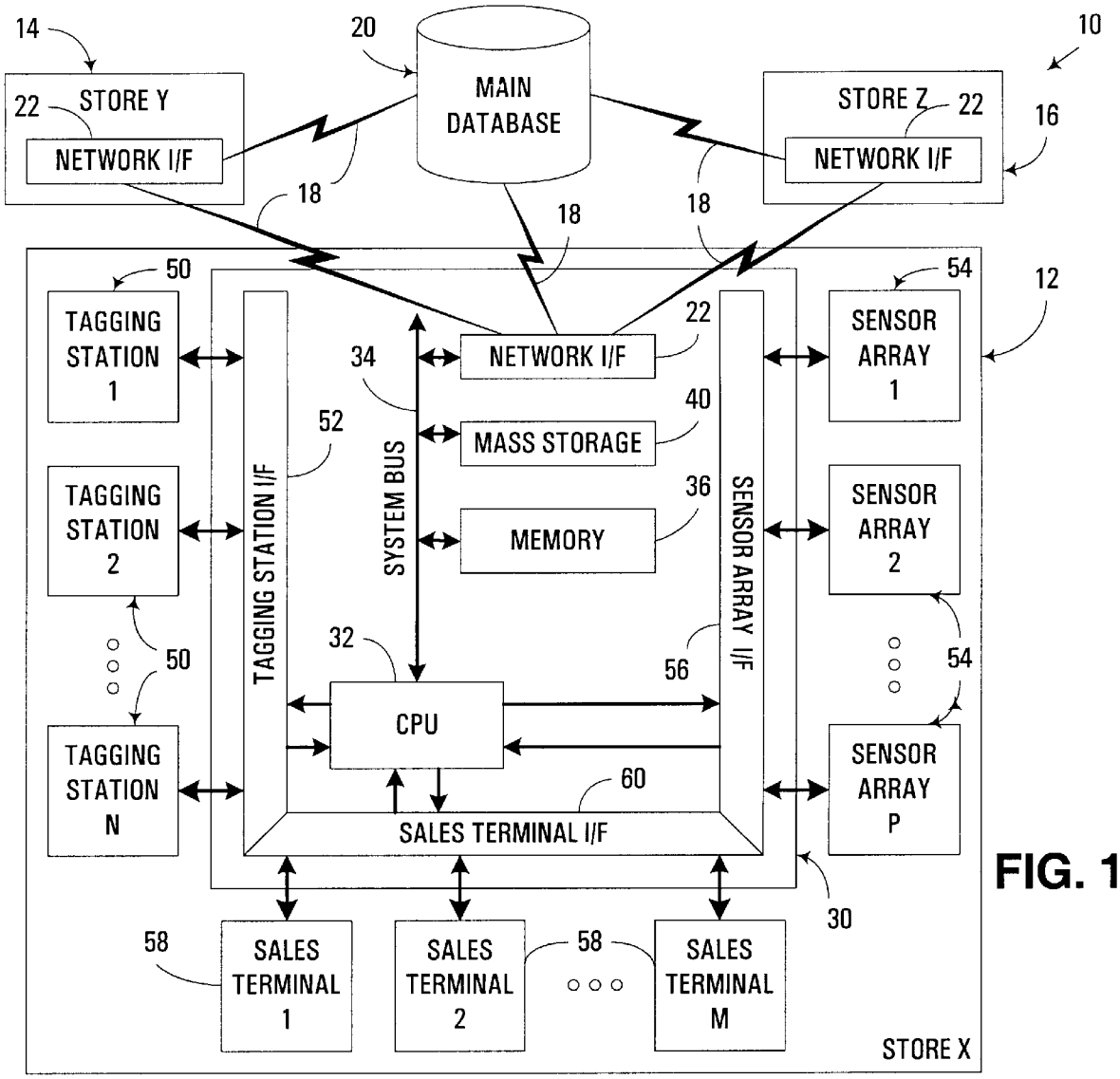
FIG. 1 is a block diagram of a customer tracking system consistent with the invention.

Turning to the Drawings, wherein like numbers denote like parts throughout the several views, FIG. 1 illustrates a customer tracking system 10 consistent with the invention. Customer tracking system 10 is illustrated as a distributed and networked data processing system that interfaces one or more retail locations (e.g., stores 12, 14, and 16) to a central (main) database 20 using a network 18. Main database 20 may be resident, for example, on one or more servers or other multi-user computers (e.g., a PC-based server, a minicomputer, a midrange computer, a mainframe computer, etc.), with the network link 18 between each store and another store and/or the main database implemented using any type of known networking technology, e.g., local-area, wide-area, wireless, and public networks (e.g., the Internet). Moreover, any number of network topologies, e.g., peer-to-peer, client-server, etc., may be used to communicate information between the stores and main database. Additional devices may also be networked through network 18 consistent with the invention.

Each store 12, 14, 16 is interfaced to network 18 via a network interface 22 resident in a store computer (e.g., store computer 30 for store 12). Store computer 30, which may also be referred to herein as an apparatus, may represent practically any type of computer, computer system or other programmable electronic device, including a client computer, a server computer, a portable computer, a handheld computer, an embedded controller, etc. Apparatus 30 will hereinafter also be referred to as a "computer", although it should be appreciated the term "apparatus" may also include other suitable programmable electronic devices consistent with the invention.

Store computer 30 typically includes at least one processor or CPU 32 coupled via a bus 34 to memory 36. CPU 32 may represent one or more processors (e.g., microprocessors), and memory 36 may represent the random access memory (RAM) devices comprising the main storage of computer 30, as well as any supplemental levels of memory, e.g., cache memories, non-volatile or backup memories (e.g., programmable or flash memories), read-only memories, etc. In addition, memory 36 may be considered to include memory storage physically located elsewhere in computer 30, e.g., any cache memory in a processor 32, as well as any storage capacity used as a virtual memory, e.g., as stored on a mass storage device 40 or on another computer or electronic device coupled to computer 30.

Computer 30 also typically receives a number of inputs and outputs for communicating information externally. For interface with a user or operator, computer 30 typically includes one or more user input devices (e.g., a keyboard, a mouse, a trackball, a joystick, a touchpad, and/or a microphone, among others) and a display (e.g., a CRT monitor, an LCD display panel, and/or a speaker, among others). A printer may also be used to print tracking data and reports.

For additional storage, computer 30 may also include one or more mass storage devices 40, e.g., a floppy or other removable disk drive, a hard disk drive, a direct access storage device (DASD), an optical drive (e.g., a CD drive, a DVD drive, etc.), and/or a tape drive, among others. It should be appreciated that computer 30 typically includes suitable analog and/or digital interfaces between processor 32 and each of components 22, 36, and 40 as is well known in the art (e.g., various bus topologies for bus 34).

For the purpose of performing electronic tagging, computer 30 is interfaced to one or more tagging stations 50 via a tagging station interface 52. Likewise, location sensing is performed by one or more sensor arrays 54 interfaced to computer 30 via a sensor array interface 56. Moreover, if computer 30 serves the additional function of controlling one or more sales terminals and/or maintaining sales records, the computer may be interfaced to one or more sales terminals 58 via a sales terminal interface 60. Each of interfaces 52, 56, and 60 may alternatively couple to system bus 34 instead of directly to CPU 32.

Computer 30, like many computers, operates under the control of an operating system, and executes or otherwise relies upon various computer software applications, components, programs, objects, modules, data structures, etc. Moreover, various applications, components, programs, objects, modules, etc. may also execute on one or more processors in another computer or device coupled to computer 30, e.g., in a distributed or client-server computing environment, whereby the processing required to implement the functions of a computer program may be allocated to multiple computers over a network. Each of the local devices 50, 54 and 58 may also execute computer programs, as may any computer within which main database 20 is resident. Moreover, as will be discussed below in connection with FIG. 10, additional analysis programs may be executed either on store computer 30 or another computer to analyze logged tracking data.

In general, the routines executed to implement embodiments of the invention, whether implemented as part of an operating system or a specific application, component, program, object, module or sequence of instructions will be referred to herein as "computer programs", or simply "programs". The computer programs typically comprise one or more instructions that are resident at various times in various memory and storage devices in a computer, and that, when read and executed by one or more processors in a computer, cause that computer to perform the steps necessary to execute steps or elements embodying the various aspects of the invention. Moreover, while the invention has and hereinafter will be described in the context of fully functioning computers and computer systems, those skilled in the art will appreciate that the various embodiments of the invention are capable of being distributed as a program product in a variety of forms, and that the invention applies equally regardless of the particular type of signal bearing media used to actually carry out the distribution. Examples of signal bearing media include but are not limited to recordable type media such as volatile and non-volatile memory devices, floppy and other removable disks, hard disk drives, magnetic tape, optical disks (e.g., CD-ROM's, DVD's, etc.), among others, and transmission type media such as digital and analog communication links.

In addition, various programs described hereinafter may be identified based upon the application for which they are implemented in a specific embodiment of the invention. However, it should be appreciated that any particular program nomenclature that follows is used merely for convenience, and thus the invention should not be limited to use solely in any specific application identified and/or implied by such nomenclature.

Those skilled in the art will recognize that the exemplary environment illustrated in FIG. 1 is not intended to limit the present invention. Indeed, those skilled in the art will recognize that other alternative hardware and/or software environments may be used without departing from the scope of the invention.

For example, different numbers of sensor arrays, tagging stations and sales terminals may be implemented in a customer tracking system, and sales terminals may not be required in some instances. Computer hardware may be disposed at a single location or may be dispersed among multiple locations to implement the functionality described herein. Moreover, the sensor arrays and/or tagging stations may be remotely located from a computer such as computer 30, and either the sensor arrays or tagging stations may be implemented in separate and independent systems.

Other modifications will be apparent to one of ordinary skill in the art.

Tag Application

The application of electronically-readable tags in the illustrated embodiments is based upon a magnetic composition such as an ink that is applied to the footwear of a customer, typically when that customer enters an establishment. The magnetic composition is typically applied in a predetermined pattern including a plurality of pattern elements that are magnetized to different magnetic polarities to represent logic states to be encoded in an electronically-readable code.

Various magnetic compositions may be used, typically incorporating a magnetic ink formed of a colloidal suspension of a ferromagnetic material such as iron oxide, nickel, etc. The ink is typically designed to adhere to common sole materials such as leather and rubber, as well as to have a sufficient vapor pressure to allow rapid drying (e.g., several seconds or less) so that suspended magnetic particles may be magnetized before the particles are locked into place as the liquid vehicle in the ink dries. Thus, it is typically desirable to apply the ink and apply a magnetic field to the ink prior to the ink drying. In the alternative, the magnetic field could be applied after the ink has dried; however, often a weaker magnetic field would typically result. It may also be desirable to prepare a sole prior to application of magnetic composition, e.g., via a carpet or other surface that removes loose debris from the footwear or dries the sole.

Figure 2:
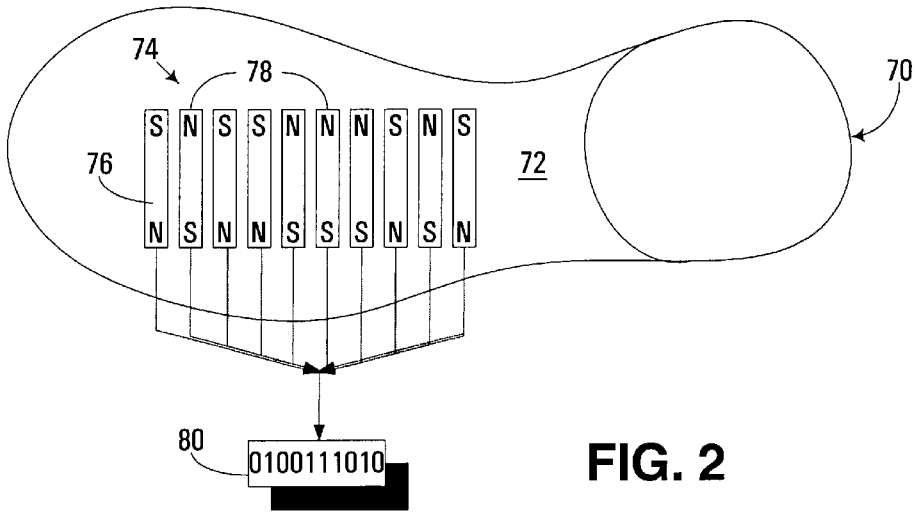
FIG. 2 is bottom plan view of footwear bearing an electronically-readable code applied by a tagging station from the customer tracking system of FIG. 1.

A number of patterns may be used to encode an electronically-readable code with a magnetic composition. For example, FIG. 2 illustrates the bottom of a shoe 70 wherein a sole 72 has a (greatly enlarged) pattern 74 of magnetic composition 76 formed by a plurality of bars or stripes 78, each selectively magnetized to one of two opposing polarities. Based upon the polarity applied to a particular stripe, that polarity is used to encode a bit in a sequence of binary numbers forming an electronically-readable code 80. It is believed that the use of relatively long bars or stripes in a linear array would provide a relatively robust magnetic field that is resistant to demagnetization due to poor application, dirt, grit, shoe geometry, poor ink adhesion, and normal wear as a customer walks through a retail establishment. In some embodiments, the patterns may be repeated at several locations on the bottom of a shoe for redundancy in case a pattern is not readable.

Typically, each stripe encodes a single bit of an electronically-readable code, although in other environments, a stripe or other pattern element could have multiple magnetic fields applied along its length to encode multiple bits. Moreover, it should be appreciated that a number of other patterns may be used, e.g., a chevron pattern, a circular pattern, a radial pattern, and even a continuous film that is selectively magnetized in various regions, e.g., as with magnetic tape. In addition, it may be desirable in some instances to repeat a code within a given pattern similar to credit cards and the like.

An electronically-readable code may be encoded into magnetic composition in any number of manners. For example, each stripe in a pattern may represent a logical "1" or "0" whereby the array of pattern elements forms a binary sequence. Also, as discussed above, each pattern element may encode more than one logical bit. Code sequences may be of fixed length, e.g., ten bits (thus providing the ability to track up to one-thousand-twenty-four individuals) or may be variable in length. When permanent magnets are used in an applicator, it may be desirable to use a gray code so that only one permanent magnet would need to be physically moved in response to each application of an electronically-readable tag. In addition, in some embodiments, a tag may include additional data, e.g., time of day, entry location, etc.

Figure 3:
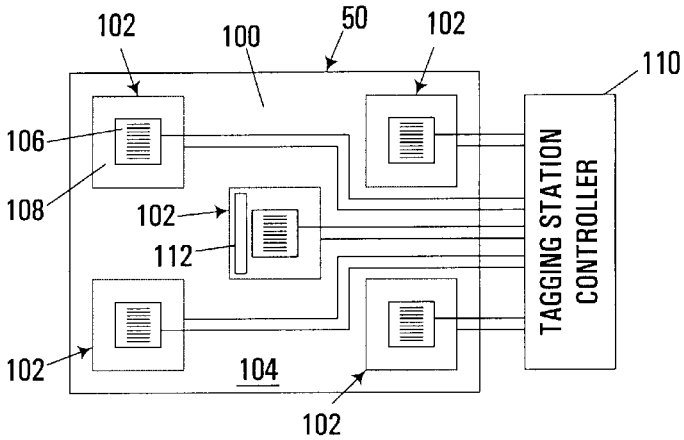
FIG. 3 is a functional top plan view of an exemplary design of a tagging station from the customer tracking system of FIG. 1.

To apply a tag, a number of applicator designs may be utilized consistent with the invention. For example, FIG. 3 illustrates a tagging station 50 from the customer tracking system of FIG. 1, here implemented as an array of tagging devices 102 disposed on a support surface 104. Each tagging device 102 includes an applicator 106 and a sensor 108 used to trigger the application of a tag responsive to the presence of an individual's footwear over the corresponding applicator. The array of tagging devices is under the control of a tagging station controller 110 that is interfaced with the store computer via the tagging station interface thereof. In addition, in some environments, it may be desirable to include a cleaning device 112 in association with each tagging device to periodically clean the nozzles in each applicator, as will be discussed in greater detail below.

Figure 4:
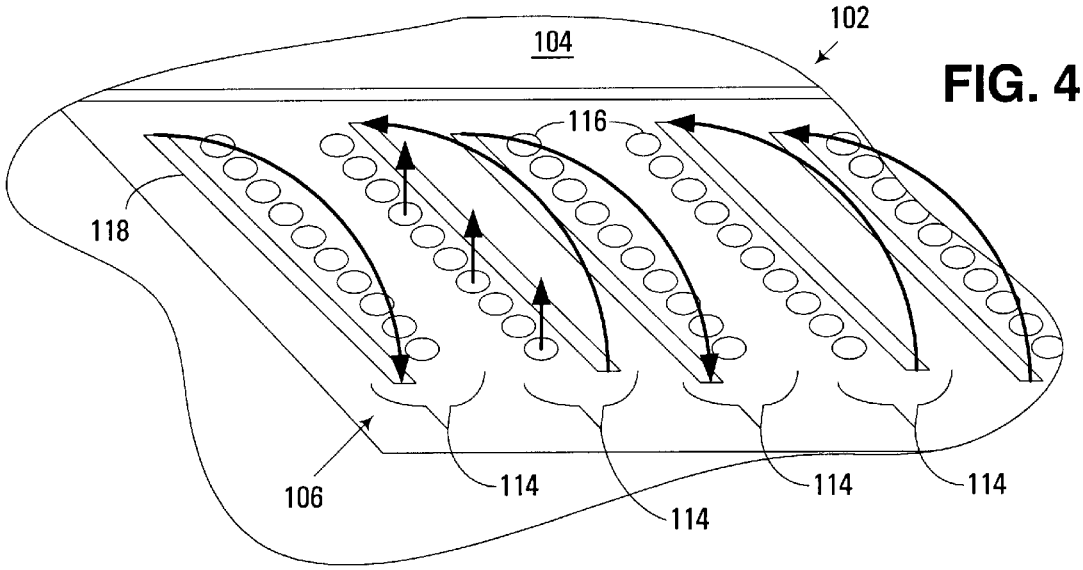
FIG. 4 is a fragmentary perspective view of a portion of an applicator from the tagging station of FIG. 3.

FIG. 4 illustrates in greater detail a portion of a tagging device 102 wherein an applicator 106 is disposed within a recess or aperture 112 formed in support surface 104. The applicator includes a linear array of applicator elements 114, each of which including a linear array of nozzles 116 and an electromagnet 118. Each nozzle array 116 is configured to apply a stripe of magnetic composition, and the associated electromagnet 118 is configured to apply a magnetic field to magnetize the magnetic particles within the magnetic composition after application of the magnetic composition but before the liquid vehicle therein dries, as illustrated by the arrows along the lengths of electromagnets 118. The direction of polarization by the electromagnets is along the so-called easy axis of magnetization for the stripes. The easy axis (that is the axis that is the most difficult to demagnetize) is the longer dimension for a thin, long structure such as a stripe. Each nozzle in each nozzle array may deposit magnetic ink in any of a number of known manners, e.g., using various ink jet, screen print or other printing technology, and as is appropriate for the particular chemical attributes of the magnetic composition.

As shown in FIG. 4, it may be desirable to alternate the placement of the electromagnets along the linear array of element applicators to minimize interference. The energizing of the electromagnets and/or the order of deposition of magnetic ink may also be staggered slightly in time to further reduce interference. For example, even pairs of nozzles and electromagnets may operate prior to the odd pairs to minimize interference.

It should be appreciated that permanent magnets may be used in some embodiments, and moreover, that other nozzle designs may be utilized in the alternative. Moreover, the placement of nozzle arrays and electromagnets may be varied in different embodiments.

In some applications, it may be desirable to utilize a fast-drying ink so that application of magnetic composition and magnetization of the same occurs in a fraction of a second so that persons entering a business or other facility are not delayed by the tagging. In addition, it may be desirable to utilized a clear liquid medium to minimize any undesirable appearance of the ink on an individual's footwear. Furthermore, it should be appreciated that the dimensions of the magnetic tag shown in FIG. 2 are greatly enlarged to facilitate an understanding of the arrangement of a pattern. In practice, it is typically possible to utilize a tag that is substantially smaller in scale.

Returning to FIG. 3, various manners of triggering the deposition of magnetic composition may be used consistent with the invention. For example, a touch or weight sensitive sensor may be disposed on top of or under the support surface of a tagging station to detect the weight of a customer's footwear over an applicator. In the alternative, an optical sensor may be utilized to provide similar functionality. The support surface may be integrated into the floor, or may be built into a mat or rug, or otherwise placed on top of the floor. Any surface capable of supporting an individual's foot during tag application may be used as a support surface.

In addition, it will be appreciated that various arrangements of applicators may be utilized to ensure that as many customers as possible are electronically tagged in the manner disclosed herein. For example, linear arrays of applicators may be utilized, as may other patterns. Moreover, the spacing between applicators may vary, e.g., to within one-half of an average stride of an individual, to maximize the likelihood that an individual steps on an applicator. Controller 110 may be configured to detect likely repeat applications of a customer due to stepping on multiple applicators by detecting activation of multiple detectors within a given time frame.

It may also be desirable to provide visual cues to customers to step on applicators, and even to encourage customers to step on the applicators, e.g., in response to an incentive such as coupon, discount, etc. Moreover, customers may be "herded" into a tagging station, e.g., by requiring users to enter an establishment through narrowed aisles one at a time such that the likelihood of a customer not stepping on an applicator is minimized.

Various modifications may be made to the tagging stations disclosed herein consistent with the invention. For example, as shown by cleaning mechanism 112 of FIG. 3, it may be desirable to clean an applicator periodically, particularly given the potential clogging of nozzles due to fast-drying ink. A certain degree of reliability is ensured by the use of an array of nozzles, nonetheless, it may be desirable to use a wiping element, sponge, brush, or like cleaning device in connection with a liquid or cleaning solution that wets the surfaces of the nozzles and removes dried ink that might otherwise clog the nozzle. The cleaning mechanism may incorporate a rotating wiper arm that sits in a solution and works much like a windshield wiper to wipe across the surface of the nozzles. The cleaning mechanism may be automatically activated after a predetermined number of application cycles, or may be manually triggered by an operator. Moreover, the mechanism may be built into the support surface so that a relatively flat and safe support surface is provided for users. Moreover, applicators may be disposed on rotatable turnstiles and rotated or otherwise transposed into a second position under the support surface for cleaning.

A cleaning mechanism may also incorporate a rotating belt that includes an aperture and which circumscribes an applicator to cycle between an operative position in which the aperture is oriented over the applicator, and a cleaning position over which a cleaning material wet to the inside surface of the belt, and potentially including bristles or other cleaning devices as the belt, is drawn across the surface of the applicator.

Other manners of applying magnetic compositions may be used in the alternative. For example, a sponge or stamp-type applicator may be used to apply ink rather than nozzles. Moreover, in some embodiments, magnetic composition may be disposed on a backing and applied as a tape or sticker. In addition, an applicator may be configured to apply magnetic composition when an individual's footwear is disposed proximate to, but not necessarily contacting the support surface, e.g., as may occur in response to detection of the presence of an individual's foot prior to actually stepping on the applicator. Other modifications will be apparent to one of ordinary skill in the art.

Tag Detection

Given the magnetic nature of the tags used in the illustrated embodiment, sensing of tags is typically performed using proximity sensors disposed at various locations throughout an establishment. While it is possible to include sensors at every possible location in a store, and thus provide precise location information of all customers at any given instance, it is typically sufficient to place sensors at strategic locations where customer traffic and browsing patterns are of interest. For example, it may be desirable to place sensors near a new product display to determine which customers after visiting a particular display actually buy an associated product. This can be determined by placing sensors near a display and also near a sales station, or alternatively, a purchase can be tied to a specific customer by reading the tagged code at the time of purchase and relating this to whether the customer visited the display earlier.

Typically, magnetically-based sensors are not as sensitive to proximity as an applicator, and thus, relatively inexpensive magnetic sensors may be used to detect electronically-readable tags with sufficient reliability.

One difficulty associated with sensing a tag in the herein-described environment is the inability to control the orientation of a customer coming in contact with a sensor. For a reliable determination of an electronically-readable tag, it is desirable to provide a mechanism that permits a tag to be read regardless of the orientation of the tag relative to a sensor.

Figure 5:
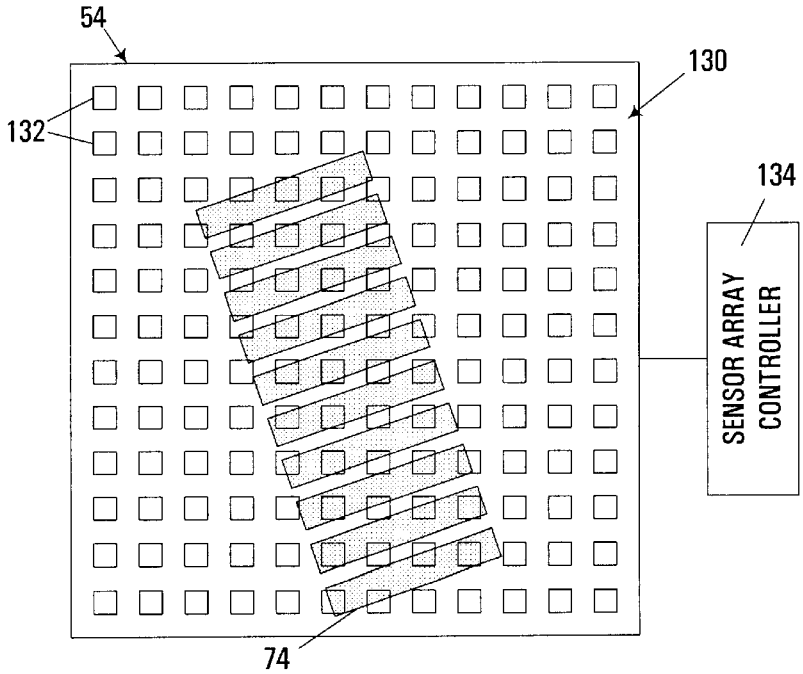
FIG. 5 is a functional top plan view of an exemplary design of a sensor array from the customer tracking system of FIG. 1.

FIG. 5, for example illustrates an exemplary sensor array design 54 suitable for providing orientation-independent detection of an electronically-readable tag. Array 54 includes a support surface 130 and a plurality of magnetic sensors 132 organized into a two-dimensional rectangular array. A sensor array controller 134 is configured to interface the plurality of magnetic sensors with the store computer. Typically, the controller 134 includes suitable logic circuitry capable of performing pattern recognition based upon the individual outputs of the magnetic sensors. Generally, the magnetic sensors are provided with a spacing that is sufficient to accurately detect both the presence and orientation of the stripes in a tag 74. For example, it may be desirable to provide a grid spacing at or below one-half the stripe spacing. It should also be noted that the utilization of such an array permits the direction of an individual to be determined with some degree of certainty. In this regard, it may be desirable to eliminate as possible code sequences any symmetric sequences that cannot be resolved as to direction.

The magnetic sensors 132 utilized in each sensor array may be, for example, magneto-resistive (MR) sensors such as used in badge readers and disk drives. Typically, the output signals from the magneto-resistive sensors are independent of the relative velocity of the magnetic field, with the MR current flow being a function of the applied magnetic field. By operating each MR sensor in its linear region, a direction of magnetization for a particular stripe in a tag pattern can be determined, similar to methods of detecting magnetic bit patterns on the surface of a disk in a hard drive.

It should be appreciated that other forms of magnetic sensors may be used in the alternative, e.g., hall sensors and coiled wire-type magnetic sensors such as flux gates, among others.

Figure 6:
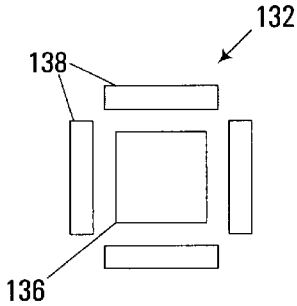
FIG. 6 is a functional top plan view of a magnetic sensor from the sensor array of FIG. 5.

As shown in FIG. 6, each magnetic sensor 132 may include an MR device 136, and may include shielding 138 in each direction to shield the sensor from magnetic fields from adjacent magnetic composition not above the sensor. The shields may be formed of a high magnetic permeability material such as MU-metal, permalloy, or other suitable materials.

Figure 7:
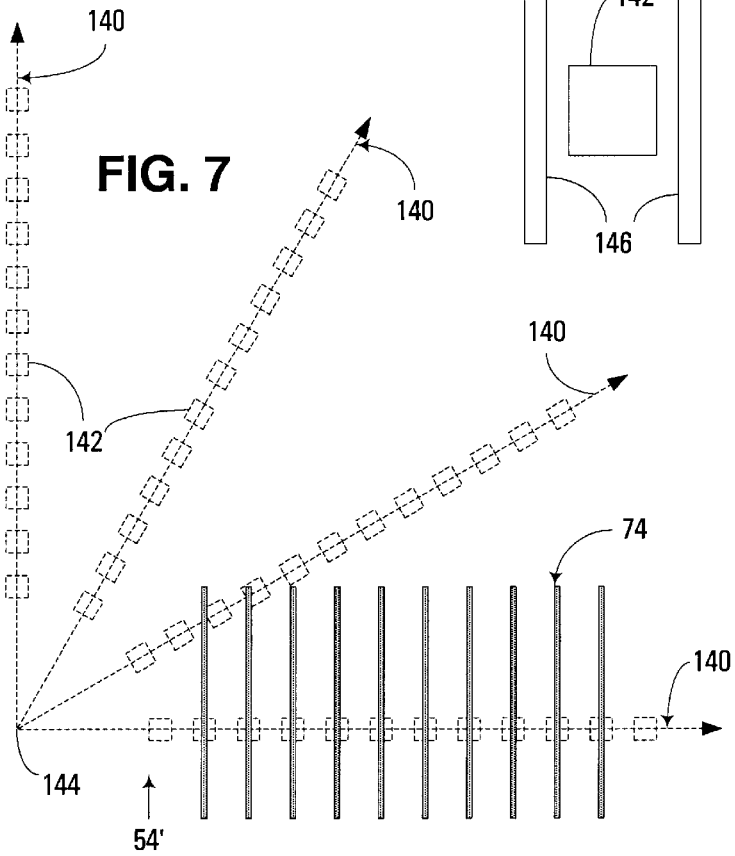
FIG. 7 is a fragmentary functional top plan view of an alternate design of a sensor array to that of FIG. 5.
Figure 8:
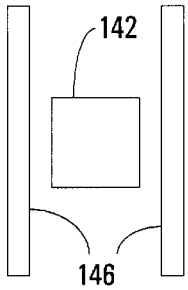
FIG. 8 is a functional top plan view of a magnetic sensor from the sensor array of FIG. 7.

Various alternate sensor array configurations may be utilized consistent with the invention. For example, rather than the rectangular array illustrated in FIG. 5, a polar array of sensors may be utilized. Furthermore, as shown in FIG. 7, hub and spoke-type array may be utilized to compensate for alignment differences between a tag pattern on the bottom of footwear and sensor. In operation, a particular spoke would be chosen that provides the strongest or least ambiguous response. As shown in FIG. 7, for example, a portion of a sensor array 54' is shown, including a plurality of linear arrays 140 of magnetic sensors 142, with each linear array spaced every 30° around a hub 144. The pitch of the sensors 142 is typically similar to that of the stripes in a tag 74. Also, as shown in FIG. 8, for each magnetic sensor 142, it may be desirable to provide shielding 146 along each side adjacent another sensor, for the same purpose of reducing interference from adjacent stripes.

The size of a sensor array is typically selected to ensure that a customer will step on the array if that customer is disposed within a desired region for detection. The larger the grid, the better redundancy and accuracy may be obtained. Moreover, orientation or pace may also be derived from the array output. Moreover, if the array is larger than the typical footprint of an individual's footwear, precise positioning of the foot over the array is not as critical.

A sensor array may be permanently mounted on or under the flooring within an establishment, or in the alternative, may be disposed on a carpet, rug or mat that may be movable to other locations. Moreover, the mat may include multiple arrays of sensors, and may be large enough to reduce the likelihood a customer not triggering a sensor when the customer is located within a region being monitored. Sensor arrays may also be incorporated into the steps of an escalator, the floor of an elevator, or other appropriate locations.

Returning to FIG. 5, sensor array controller 134 may include any suitable logic and interface circuitry to report the output of sensors 132 to the store computer. Instead of a controller, a simpler electronic circuit may be utilized in the alternative, with additional processing utilized in the store computer to detect and determine the electronically-readable code from the magnetic sensor output. In the alternative, the electronic circuit or controller 134 may be sophisticated enough to perform pattern matching and other processing so that the binary equivalent electronic code is output to the store computer. Moreover, various manners of communicating the sensor output to the store computer may be used, including any combination of passive and active components, controller circuitry, and the like. Moreover, various networking capabilities, including direct, serial or parallel interfaces, packetized interfaces, local area network, wide area network or Internet-based communication protocols may be utilized to output sensor array information to a store computer. Thus, it should be appreciated that an electronic circuit that determines the code may be a localized circuit or controller dedicated to the sensor array, the store computer, a remote computer coupled to the main database, or any other circuitry capable of analyzing the outputs of the magnetic sensors and deriving the code.

Moreover, sensor array output may be made in real time, or may be stored locally and output at intervals or upon demand in batches. Practically any manner of logging and storing a database of information may be utilized to ensure that magnetic sensor data is routed to the main database for analysis in the manner discussed below.

Other modifications will be apparent to one of ordinary skill in the art.

Customer Tracking

Figure 9:
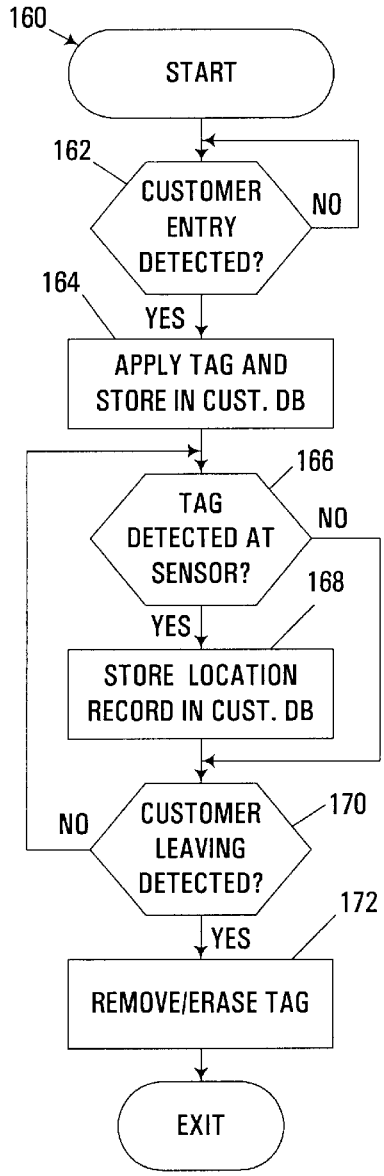
FIG. 9 is a flowchart illustrating the sequence of operations that occur in tracking a customer in the customer tracking system of FIG. 1.

FIG. 9 illustrates a customer tracking operation 160 performed by customer tracking system 10 of FIG. 1. In particular, at block 162, it is determined whether a customer entry has been detected, e.g., based upon the activation of a tagging station typically disposed at the entry of a store. If no customer entry is detected, block 162 repeats. Once a customer entry has been detected, however, control passes to block 164 to apply the tag and store the electronically-readable code therefor in the customer database, e.g., by activation of the tagging station and transmission of the electronically-readable code to the store computer.

Next, a loop is initiated while the customer is in the store. The loop begins at block 166 by determining whether the tag for the customer is detected at a sensor. If such a tag is detected, control passes to block 168 to store a location record in the customer database, typically including the detected code, the location of the sensor array (e.g., any form of identifier capable of identifying the sensor array), and optionally, a time stamp. Additional information, e.g., orientation and/or speed, may also be provided. Control then passes to block 170 to determine whether a customer leaving has been detected, e.g., via detection of the customer tag proximate an exit to the store. If not, control returns to block 166. Moreover, at block 166, if no tag is detected at the sensor, block 168 is bypassed, and control passes directly to block 170.

Once the customer leaving has been detected, control passes from block 170 to 172 to remove or erase the tag, whereby the tracking of the customer is complete. The removal occurs therefore in response to a customer leaving a tracking area (e.g., the store).

Removal or erasing of a tag may be optionally performed by a high frequency field source located proximate the exit to a store (e.g., in the floor), similar to systems used to demagnetize security tags placed on products such as CD's, computer software and the like.

It should be appreciated that the functionality disclosed with reference to FIG. 9 may be allocated to various components within customer tracking system 10. For example, generation of code to be applied at a tagging station may be performed by the tagging station, by an individual applicator, by the store computer, by a central controller, etc. Moreover, detection of a tag will typically be allocated to the various sensor arrays disposed throughout a store. It should also be appreciated that, in general, tags can be applied, sensed, removed and re-applied anywhere in a store.

Moreover, it will be appreciated that the manner of tracking multiple customers may be implemented using a number of different programming models. For example, tracking of each customer may result in the creation of a tracking thread associated with that customer within the store computer, to manage all of the data generated for that customer. In the alternative, the store computer may simply forward location data directly to the main database in the form of location records, with no separate monitoring of individual customers other than providing the code within each location record. In the alternative, the store computer may maintain a copy of the data stored in the main database, to perform store-specific analysis of customer data within the store. Other modifications will be apparent to one of ordinary skill in the art.

Customer Location Data Analysis and Utilization

Based upon the customer location data generated in the manner disclosed herein, various analysis operations may be performed to derive useful information from the data. In general, information such as the number of customers in a store at any given time, the distribution of customers throughout the store, the duration that individual customers spend at certain locations, the duration that customers remain in the store, and even the orientation of particular customers at a particular location (i.e., which direction they are facing) may be determined. Moreover, by placing sensor arrays proximate cash register locations, records of purchases may be associated with customers to provide further information such as a determination of whether a customer that visited a certain location ultimately purchased a product from that location. In addition, through the use of multiple sensors, it may be possible to detect a customer's pace or speed, or how long a customer stopped at a certain location. Moreover, the number of people passing a particular location could be determined.

The purposes for which such data may be gathered and analyzed include, for example, improving the layout of a store or product display to improve marketing effectiveness, traffic flow, traffic distribution, marketing effectiveness, safety, noise levels, customer comfort, architectural design, etc. The data might be used to determine liability insurance rates, cleaning schedules, maintenance schedules, etc.

Figure 10:
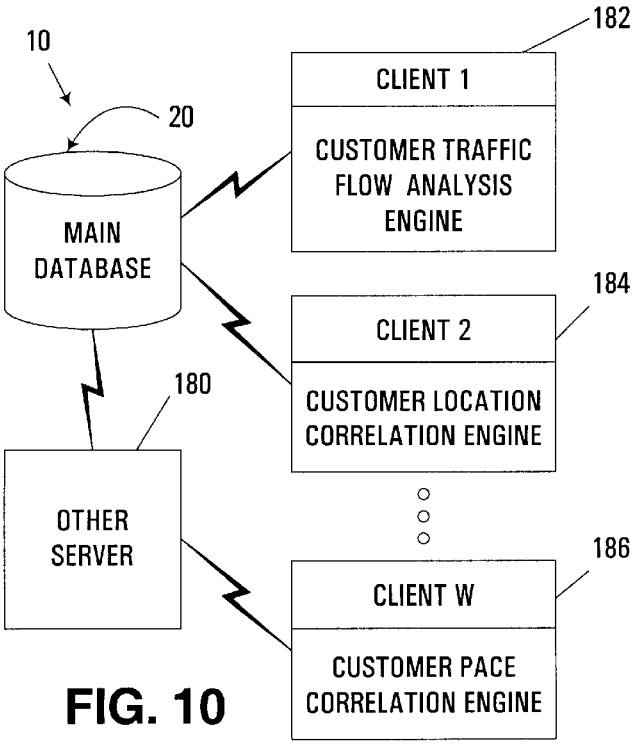
FIG. 10 is a block diagram of an analysis system used to analyze tracking data in the customer tracking system of FIG. 1.

One manner in which customer data may be analyzed is illustrated, for example, in FIG. 10, showing main database 20 of customer tracking system 10 interfaced with another server 180, as well as a plurality of clients 182, 184 and 186. Client 182, for example, may include a customer traffic flow analysis engine that analyzes customer traffic flow patterns, orientation and sales. Client 184 may include a customer location correlation engine that analyzes the correlation between customer location and sales. Client 186 may include a customer pace correlation engine used to analyze the correlation between customer pace and safety. For this latter client, additional information, such as safety data and instances of accidents may also be used. Also, it should be noted that each of clients 182-186 may connect directly to the main database, or may be interfaced through another server 180. Other analysis engines may also be used to perform other analysis operations consistent with the invention.

Alternative Embodiments

As discussed above, while the herein-described customer tracking system has a predominant use in tracking customers within a retail establishment, it will be appreciated that tracking of individuals may be performed in a similar manner, e.g., within any type of business enterprise, within a sports event, entertainment event, a prison, hospital, or any other time that traffic flow analysis is desired. It may be desirable, for example, to analyze traffic flow within a building or public space, e.g., to refine architectural designs. Moreover, the tag application and tracking systems may be utilized separate from one another.

Additional functionality may also be imparted to a customer tracking system consistent with the invention. For example, gender determination may also be utilized to enhance the customer tracking data. A pressure sensor that detects weight, or an optical sensor that determines shoe size, could be used to distinguish between men, women, and/or children, with this additional information associated with customer tracking data to determine whether a particular customer is male or female. In addition, sensors may be positioned proximate applicators to both verify the entry of a customer into a store, as well as to potentially detect failed applicators. Mechanisms may also be included in a system to detect when an applicator is low on magnetic ink or other fluids.

Moreover, with respect to customer location analysis in a retail environment, other electronic tagging technologies may be used. While the herein described deposition of magnetized composition to customer footwear is believed to be well suited to customer location tracking, other technologies capable of inconspicuously tagging and sensing applied tags may also be used, e.g., through application to other parts of a customer's person (other clothing or other parts of the body), or through other electronically-readable tags (e.g., incorporating optically-readable tags, physically-applied transmitters and/or IC devices, etc.). As used herein, "inconspicuous" generally refers to a manner of applying a tag and/or sensing that does not require substantial customer interaction, does not require significant conscious actions on the part of customers, and typically does not require a customer to alter his or her gait or movement outside of normal movement through an establishment. An inconspicuous application or sensing operation may or may not be with the knowledge of customers, and thus the knowledge of a customer that he or she is being tagged or sensed does not necessarily render the tagging or sensing conspicuous with the context of the invention.

Moreover, proximity-type sensors other than magnetic sensors (e.g., optical, RF, electronic, etc.) may be distributed throughout a store or other tracking area, with such proximity-type sensors being adapted to detect the electronically-readable tags applied to a customer.

As an example of an optical-based tagging technology, an optically-readable composition such as a dye or ink may be applied with a pattern that varies in pattern element spacing and/or size to encode a unique code for a customer, much like a bar code. Cooperative optical sensors, using any of the sensor arrangements described above, may be used to sense the optically-readable composition. Furthermore, in some embodiments, it may be desirable to utilize a luminescent or phosphorescent composition for the optically-readable composition, with a suitable excitation mechanism such as a light or other energy source used in connection with an optical sensor to improve the sensitivity of the optical sensor, and thus improve the detectability of the tags.

Additional modifications will be apparent to one of ordinary skill in the art. Therefore, the invention lies in the claims hereinafter appended.

What is claimed is:

1. A method of applying an electronically-readable tag to an individual, the method comprising applying a magnetic composition to an individual's footwear when the individual is located at a tagging location, the magnetic composition magnetized with an electronically-readable code, wherein applying the magnetic composition includes:

(a) depositing the magnetic composition in a predetermined pattern comprising a plurality of pattern elements; and (b) applying a magnetic field to the magnetic composition in each of the pattern elements, the magnetic field applied to the magnetic composition in each pattern element configured to magnetize the magnetic composition to one of a pair of magnetic polarities such that the electronically-readable code is defined by the magnetic polarities of the magnetic composition in the plurality of pattern elements.

2. The method of claim 1, wherein applying the magnetic composition to the individual's footwear comprises spraying a magnetic ink onto a sole of the individual's footwear.

3. The method of claim 1, applying the magnetic field to the magnetic composition in each of the pattern elements is performed after deposition of the magnetic composition.

4. The method of claim 1, wherein depositing the magnetic composition in the predetermined pattern includes depositing a plurality of stripes of magnetic composition.

5. The method of claim 4, wherein the plurality of stripes of magnetic composition are arranged in a linear array.

6. The method of claim 5, wherein applying the magnetic field to the magnetic composition in each of the pattern elements includes applying magnetic fields to adjacent pattern elements at different times.

7. The method of claim 1, further comprising detecting an individual stepping within a predetermined area in the tagging location, wherein applying the magnetic composition is performed in response to detection of the individual stepping within the predetermined area.

8. The method of claim 1, further comprising demagnetizing the magnetic composition in response to the individual leaving a predetermined tracking area.

9. An apparatus, comprising:

(a) a support surface configured to be stepped upon by an individual; and (b) an applicator configured to electronically tag the individual by applying a magnetic composition to the individual's footwear while the individual's footwear is disposed over the support surface, the magnetic composition magnetized with an electronically-readable code.

10. The apparatus of claim 9, wherein the applicator is further configured to apply a magnetic field to the magnetic composition after application of the magnetic composition to the individual's footwear.

11. The apparatus of claim 9, wherein the applicator comprises a plurality of nozzles configured to spray a magnetic ink onto a sole of the individual's footwear.

12. The apparatus of claim 11, wherein the magnetic ink comprises a colloidal suspension of a ferromagnetic material.

13. The apparatus of claim 11, wherein the applicator is configured to spray the magnetic ink in a predetermined pattern comprising a plurality of pattern elements, wherein the plurality of nozzles are arranged into a plurality of applicator element arrays, each applicator element array configured to spray magnetic ink for a pattern element in the predetermined pattern.

14. The apparatus of claim 13, wherein the applicator further comprises a plurality of electromagnets, each electromagnet disposed adjacent an associated applicator element array and configured to selectively apply one of a pair of magnetic polarities to the magnetic ink sprayed by the applicator element array associated therewith, such that the electronically-readable code is defined by the magnetic polarities of the magnetic ink in the plurality of pattern elements.

15. The apparatus of claim 14, wherein the nozzles within each applicator element array are linearly arranged to form a stripe of magnetic ink on the individual's footwear, wherein each electromagnet extends generally parallel to the linear arrangement of nozzles in the associated applicator element array.

16. The apparatus of claim 15, wherein the plurality of applicator element arrays are arranged into a linear array to form a plurality of parallel stripes of magnetic ink.

17. The apparatus of claim 16, wherein electromagnets associated with adjacent applicator element arrays are disposed on opposite sides of the respective associated pattern element arrays.

18. The apparatus of claim 16, wherein the applicator is configured to activate adjacent electromagnets at different times.

19. The apparatus of claim 9, further comprising a detector configured to detect an individual stepping on the support surface, wherein the applicator is configured to apply the magnetic composition responsive to a control signal from the detector.

20. The apparatus of claim 9, further comprising a cleaning mechanism configured to clean the applicator.

21. A method of tracking an individual, comprising:

(a) sensing a magnetized composition disposed on an individual's footwear, while the footwear is being worn by the individual, using a magnetic sensor disposed at a predetermined location;

(b) determining an electronically-readable code for the individual from the sensed magnetized composition; and (c) storing the electronically-readable code in a database in response to sensing the magnetized composition, wherein storing the electronically-readable code includes associating at least one of a position indicator and a time stamp with the electronically-readable code.

22. The method of claim 21, wherein storing the electronically-readable code further includes generating a record in the database that identifies the electronically-readable code, a position indicator and a time stamp.

23. The method of claim 22, wherein the magnetized composition is arranged in a predetermined pattern comprising a plurality of pattern elements, each pattern element magnetized to one of a pair of magnetic polarities, each magnetic polarity associated with a binary value, wherein determining the electronically-readable code includes determining a binary sequence based upon the magnetic polarity of each pattern element in the magnetized composition.

24. The method of claim 23, further comprising determining an orientation of the predetermined pattern of magnetized composition.

25. An apparatus, comprising:

(a) a magnetic sensor configured to sense a magnetized composition disposed on an individual's footwear while the footwear is being worn by the individual; and (b) an electronic circuit coupled to the sensor, the electronic circuit configured to determine an electronically-readable code for the individual from the magnetized composition, wherein the magnetized composition is arranged into a predetermined pattern including a plurality of pattern elements, each pattern element magnetized to one of a pair of magnetic polarities, each magnetic polarity associated with a binary value, and the electronic circuit is configured to determine the electronically-readable code by determining a binary sequence based upon the magnetic polarity of each pattern element in the magnetized composition.

26. The apparatus of claim 25, wherein the magnetic sensor comprises a magneto-resistive sensor.

27. The apparatus of claim 25, further comprising a plurality of magnetic sensors configured to sense the magnetized composition and coupled to the electronic circuit, the plurality of magnetic sensors arranged into an array.

28. The apparatus of claim 27, wherein the array is selected from a rectangular array, a polar array, and a hub-and-spoke array.

29. The apparatus of claim 25, wherein the magnetic sensor is configured to sense a magnetic field associated with a pattern element from the predetermined pattern of the magnetized composition, the apparatus further comprising at least one shield disposed proximate the magnetic sensor to shield the magnetic sensor from magnetic fields associated with adjacent pattern elements.

30. An apparatus, comprising:

(a) a magnetic sensor configured to sense a magnetized composition disposed on an individual's footwear while the footwear is being worn by the individual; and (b) an electronic circuit coupled to the sensor, the electronic circuit configured to determine an electronically-readable code for the individual from the magnetized composition, wherein the electronic circuit comprises a sensor array controller local to the magnetic sensor, the sensor array controller configured to output the electronically-readable code to a remote computer.

31. An apparatus, comprising:

(a) a magnetic sensor configured to sense a magnetized composition disposed on an individual's footwear while the footwear is being worn by the individual; and (b) an electronic circuit coupled to the sensor, the electronic circuit configured to determine an electronically-readable code for the individual from the magnetized composition, wherein the electronic circuit comprises a computer located remote from the magnetic sensor, the apparatus further comprising a second electronic circuit coupled to the computer and configured to transmit the output of the magnetic sensor to the computer for determination of the electronically-readable code.

32. An apparatus, comprising:

(a) a magnetic sensor configured to sense a magnetized composition disposed on an individual's footwear while the footwear is being worn by the individual; and (b) an electronic circuit coupled to the sensor, the electronic circuit configured to determine an electronically-readable code for the individual from the magnetized composition, wherein the electronic circuit is further configured to determine an orientation of the individual from the magnetized composition.

33. A method of tracking customers in an establishment, comprising:

(a) electronically tagging a plurality of customers entering an establishment, including assigning a unique electronically-readable code to each customer wherein electonically tagging a customer comprises electronically tagging a customer's footwear; and (b) tracking a location of each electronically-tagged customer using a plurality of proximity sensors disposed at a plurality of locations in the establishment, wherein each proximity sensor is configured to detect the unique electronically-readable code of a customer that is located proximate thereto.

34. The method of claim 33, wherein electronically tagging a customer includes inconspicuously applying an electronically-readable tag directly to the customer's person.

35. The method of claim 34, wherein electronically tagging a customer's footwear includes applying a magnetic composition to the customer's footwear.

36. The method of claim 35, wherein applying the magnetic composition includes:

(a) depositing a magnetic ink in a predetermined pattern comprising a plurality of pattern elements; and (b) applying a magnetic field to the magnetic ink in each of the pattern elements, the magnetic field applied to the magnetic ink in each pattern element configured to magnetize the magnetic ink to one of a pair of magnetic polarities such that the electronically-readable code is defined by the magnetic polarities of the magnetic ink in the plurality of pattern elements.

37. The method of claim 35, further comprising demagnetizing the magnetic composition in response to the individual leaving a predetermined tracking area.

38. The method of claim 34, wherein electronically tagging a customer's footwear includes applying an optically-readable composition to the customer's footwear.

39. The method of claim 38, wherein the optically-readable composition comprises a phosphorescent composition.

40. The method of claim 33, further comprising storing a record in a database in response to detection of an electronically-tagged customer by a first proximity sensor, the record identifying the electronically-readable code associated with the electronically-tagged customer, a position indicator associated with the first proximity sensor, and a time stamp.

41. The method of claim 33, further comprising:

(a) storing customer location data representative of the tracked locations of the electronically-tagged customers; and (b) analyzing the customer location data.

42. The method of claim 41, further comprising storing product purchase data associated with electronically-tagged customers, wherein analyzing the customer location data includes analyzing marketing effectiveness.

43. The method of claim 41, wherein analyzing the customer location data is selected from the group consisting of analyzing traffic flow, analyzing safety, analyzing architectural design, analyzing marketing effectiveness, analyzing traffic distribution, analyzing noise levels, analyzing customer comfort, and combinations thereof.

44. The method of claim 41, wherein analyzing the customer location data includes at least one of determining whether a customer purchased a product at a product display, determining a customer's pace, determining how long a customer stayed at a location, and determining how many customers passed a location.

45. An apparatus, comprising:

(a) an electronic tagging device configured to electronically tag a plurality of customers entering a retail establishment by assigning a unique electronically-readable code to each customer;

(b) a plurality of proximity sensors disposed at a plurality of locations in the retail establishment and configured to generate customer location data associated with the locations of the plurality of customers within the retail establishment, each proximity sensor configured to detect the unique electronically-readable code of a customer that is located proximate thereto; and (c) a database configured to store the customer location data.

* * * * *